US005563639A

United States Patent [19]

Cameron et al.

[11] Patent Number: 5,563,639

[45] Date of Patent: Oct. 8, 1996

[54] VENTURI SPITTOON SYSTEM TO CONTROL INKJET AEROSOL

[75] Inventors: James M. Cameron, Portland, Oreg.; Bret Taylor, Vancouver, Wash.

[73] Assignee: Hewlett-Packard Company, Palo Alto, Calif.

[21] Appl. No.: 316,152

[22] Filed: Sep. 30, 1994

[51] Int. Cl.[6] ..... B41J 2/165

[52] U.S. Cl. ..... 347/34; 347/35; 347/36

[58] Field of Search ..... 347/22, 25, 29, 347/30, 31, 34, 35, 86, 36

[56] References Cited

U.S. PATENT DOCUMENTS

| | | | |
|---|---|---|---|
| 4,362,572 | 12/1982 | Wallace | 134/18 |
| 4,791,435 | 12/1988 | Smith et al. | 347/35 X |
| 4,875,055 | 10/1989 | McCann et al. | 347/86 |
| 4,908,636 | 3/1990 | Saito et al. | 347/25 |

FOREIGN PATENT DOCUMENTS

| | | |
|---|---|---|
| 0574268 | 6/1993 | European Pat. Off. . |

*Primary Examiner*—John E. Barlow, Jr.

[57] ABSTRACT

An inkjet printing mechanism has an inkjet printhead which controllably ejects multiple ink droplets and a carriage to carry the printhead. The carriage is designed to move the printhead through a print zone to a service station where the printhead is serviced. During a servicing mode of operation, the printhead ejects ink droplets at the service station to clear the printhead nozzle orifices prior to printing. A reservoir is provided at the service station to collect the ink droplets ejected from the printhead during the servicing mode. A venturi passageway is also positioned at the service station adjacent to the reservoir. The venturi passageway guides the ink droplets ejected from the printhead into the reservoir.

19 Claims, 6 Drawing Sheets

VENTURI SPITTOON SYSTEM TO CONTROL INKJET AEROSOL

TECHNICAL FIELD

This invention relates to inkjet printing mechanisms, and more particularly, to mechanisms for controlling inkjet aerosol in ink-jet printers, plotters, scanners, facsimile machines, and the like.

BACKGROUND OF THE INVENTION

An inkjet printing mechanism is a type of non-impact printing device which forms characters and other images by controllably spraying drops of ink from a printhead. Inkjet printing mechanisms may be employed in a variety of devices, such as printers, plotters, scanners, facsimile machines, and the like. For convenience, inkjet printers are used herein to illustrate the concepts of the present invention.

The printhead ejects ink through multiple nozzles in the form of drops which travel across a small air gap and land on a recording media. The drops are very small. Inkjet printers commonly print within a range of 180 to 600 dots per inch (dpi). The ink drops dry on the recording media shortly after deposition to form the desired printed images.

There are various types of inkjet printheads including, for example, thermal inkjet printheads and piezoelectric inkjet printheads. By way of example, for a thermal inkjet printhead, ink droplets are ejected from individual nozzles by localized heating. A small heating element is disposed at individual nozzles. An electrical current is passed through the element to heat it up. This causes a tiny volume of ink to be rapidly heated and vaporized by the heating element. Once vaporized, the ink is ejected through the nozzle. A driver circuit is coupled to individual heating elements to provide the energy pulses and thereby controllably deposit ink drops from associated individual nozzles. Such drivers are responsive to character generators and other image forming circuitry to energize selected nozzles of the printhead for forming desired images on the recording media.

During start-up just prior to a printing cycle, it is common to maneuver the printhead to a service station and prepare the printhead by firing ink drops into a reservoir. Sometimes hundreds, or even thousands, of ink drops are rapidly fired into the reservoir. This preliminary firing clears the nozzles and orifices of any ink build-up or debris in preparation for a more controllable ink deposition when the printhead is returned to the recording media. The printhead returns to the service station periodically while printing is in progress to re-clean the nozzles. Routine servicing is commonly scheduled once to twice per page of printing. The cleansing process helps maintain printhead reliability.

As the printhead is firing ink droplets into the reservoir, it releases undesired ink aerosol. Inkjet aerosol is small droplets of ink that are generated as a result of firing an inkjet printhead. These small droplets are often not deposited directly into the reservoir, but instead end up contaminating the printhead and the internal surfaces of the printing mechanism. The smaller the droplets, the more sensitive they are to outside influences such as air currents which aid in misdirecting the droplets away from the reservoir. Ink contamination causes additional undesired problems such as dirt build-up, high frictional forces on moving parts, and operator exposure to wet ink.

It is desirable to control the flow of inkjet aerosol in an effort to minimize the adverse effects of ink contamination.

One prior art solution to controlling inkjet aerosol is to provide an absorbent surface that is close to the printhead when firing. The aerosol impinges on this surface, and the liquid ink coalesces out of the air. This technique is not satisfactory, however, for inks that contain significant amounts of solids because the absorbent material can quickly clog. The accumulated solids continue to build up until they contaminate the printhead. The absorbent method also has limits for non-solid inks because a large volume of absorbent material must be provided to store the amount of ink discharged over the life of the printer. This makes the printer larger, more expensive, and imposes other restraints on the design.

SUMMARY OF THE INVENTION

According to one aspect of the present invention, a unique reservoir assembly is provided for use in an inkjet printing mechanism. The reservoir assembly includes a reservoir which collects ink droplets ejected by an inkjet printhead during a servicing mode and a venturi passageway positioned intermediate of the printhead and reservoir. The ink droplets travel through the venturi passageway following ejection from the printhead. The passageway creates a venturi effect which accelerates and directs the flow of air and ink droplets into the reservoir. The flow entrains any misdirected droplets that otherwise would be free to deposit elsewhere in the printer and forces them into the reservoir. The reservoir assembly thereby reduces the tendency of the drops to migrate out of the reservoir.

BRIEF DESCRIPTION OF THE DRAWINGS

Preferred embodiments of the invention are described below with reference to the following accompanying drawings. The drawings depict examples embodying the best mode for practicing the invention.

FIG. 1 shows a movable carriage holding a printhead and a reservoir assembly.

DETAILED DESCRIPTION OF THE PREFERRED EMBODIMENTS

The present invention relates to inkjet printing mechanisms which can be used in many different printing devices, including inkjet printers, plotters, scanners, facsimile machines, and the like. In general, an inkjet printing mechanism has one or more inkjet printheads which controllably deposit drops of ink in prescribed patterns onto a recording media. As used herein, recording media includes all forms of printable matter including, for example, continuous paper, sheet stock paper, adhesive backed labels, mylar, and the like. A typical inkjet printhead has multiple nozzles (e.g., 50 nozzles), such as that described in U.S. Pat. No. 5,278,584 by Keefe et at., which is assigned to Hewlett-Packard Company.

Figure 1:
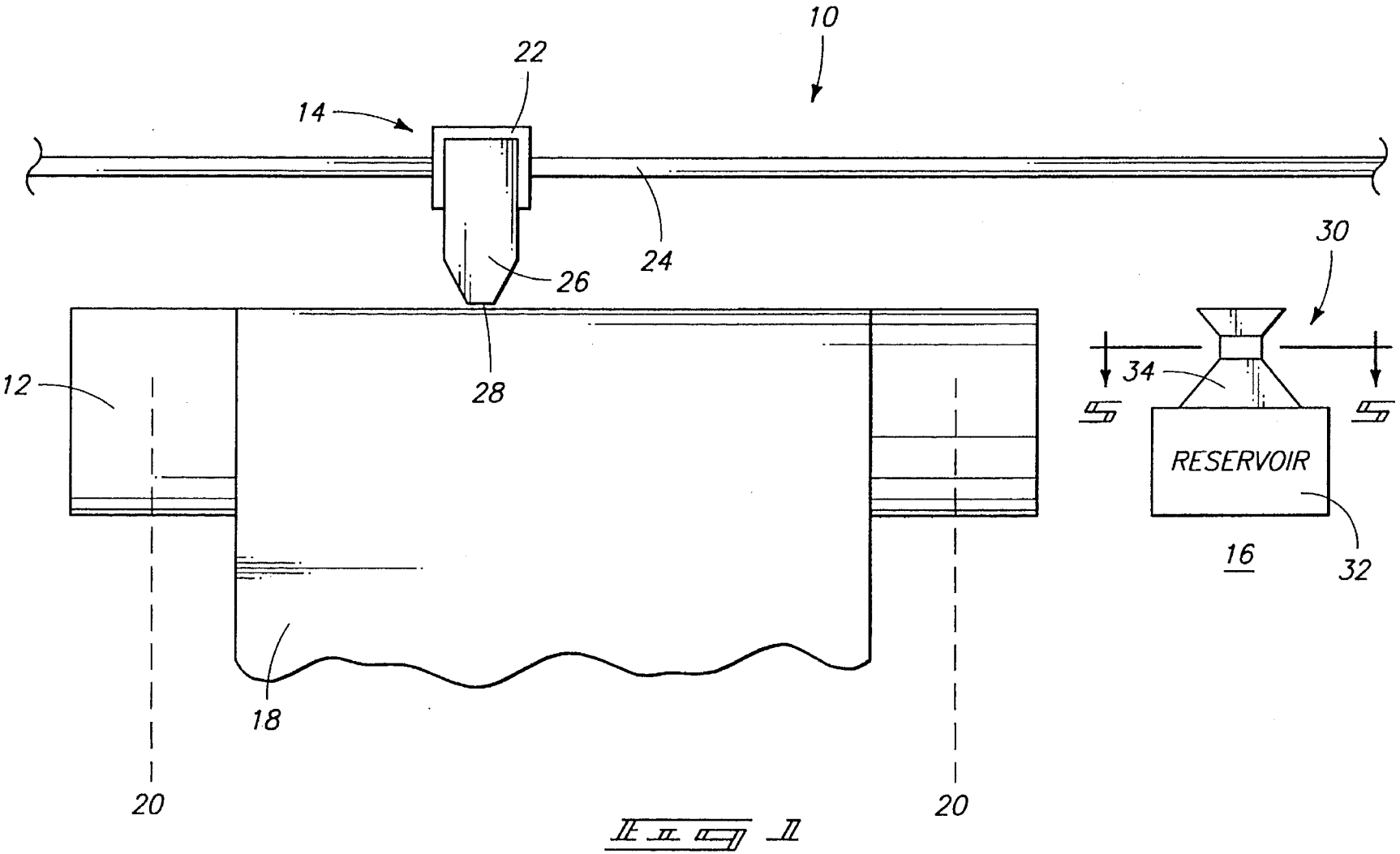
FIG. 1 is a diagrammatical side view of one form of an inkjet printing mechanism according to this invention.

FIG. 1 shows one embodiment of a shuttle-type inkjet printing mechanism 10 constructed according to this invention. Printing mechanism 10 includes a platen 12, a shuttle assembly 14, and a service station 16. Platen 12 supports a recording media 18 during printing. The platen can be stationary, or rotatable to assist in advancing the media through the printing mechanism. A media feed mechanism (not shown), such as conventional friction rollers or a tractor feed system, may be used to drive the media through the printing mechanism along a media feed path.

Printing mechanism 10 has a predefined print zone which is represented by dashed boundary lines 20. The print zone coincides at least partially with the media feed path so that the recording media is fed through the print zone. An example print zone is defined as an area within which each of the multiple printheads can print across the entire width of the recording media.

Shuttle assembly 14 includes a carriage 22 slidably mounted on a fixed, elongated guide rod 24 to move bidirectionally across platen 12. Carriage 22 is designed to maneuver over the full width of the platen, thereby entirely traversing print zone 20, as well as moving to service station 16 outside of the print zone. Shuttle assembly 14 includes a drive subassembly (not shown) that is mechanically coupled to drive carriage 22 back and forth along guide rod 24.

A typical drive subassembly includes a wire or belt attached to carriage 22 and wound around opposing pulleys, and a motor (e.g., a stepper motor or DC motor) connected to power one of the pulleys. A rotary encoder is coupled to the motor drive shall to monitor incremental shaft rotation and provide feedback data for use in positioning and controlling the carriage. The shuttle assembly 14 described herein is provided for explanation purposes and its construction is well known in the art. Other types of shuttle assembly configurations may alternatively be employed.

Carriage 22 supports and carries at least one printhead 26 which is preferably embodied as a replaceable, disposable print cartridge or pen. Printhead 26 is mounted to carriage 22 so that its nozzle section 28 is adjacent to, but spaced from, platen 12 to permit passage of the recording media therebetween. The carriage 22 moves the printhead back and forth through print zone 20 in horizontal swaths along a scan axis.

Printhead 26 can be embodied as a mono-color pen which deposits a single ink color, such as black, or as a multi-color pen which deposits multiple colors, such as Cyan, Magenta, and Yellow. An example multi-color printhead is sold by Hewlett-Packard under part number 51625A.

Carriage 22 is also designed to move printhead 26 out of print zone 20 to service station 16 where the printhead is serviced. Service station 16 is preferably located adjacent to platen 12 and outside of print zone 20. The printhead is moved to the service station during initialization procedures and then intermittently during printing.

The printhead undergoes various servicing processes at the service station, including such processes as: "wiping" where a wiper assembly (not shown) physically wipes the nozzle section of the printhead to clean it; "priming" where a pressure gradient is created within the ink conduits of the printhead to prepare the ink stream for continuous flow into the ejecting heating element; and "spitting" where the printhead fires multiple ink droplets to clear the nozzles and orifices of any ink build-up or debris. Each process prepares the printhead for high quality ink deposition when the printhead is returned to the print zone to print on the recording media. Routine servicing is typically scheduled once or twice per page of printing. These processes help maintain printhead reliability.

This invention is particularly concerned with the "spitting" process. Service station 16 has a reservoir assembly 30 for receiving the ink droplets ejected from the printhead during the servicing mode. Reservoir assembly 30 includes a reservoir 32 to collect the ink droplets and a venturi passageway 34 positioned intermediate of the printhead and reservoir to guide the ink droplets from the printhead into the reservoir 32. That is, the ink droplets spit by the printhead travel through the venturi passageway 34 which accelerates and directs the droplet stream toward the reservoir. The venturi passageway 34 can be integrally formed with reservoir 32, or alternatively, constructed separately from reservoir 32.

Figure 2:
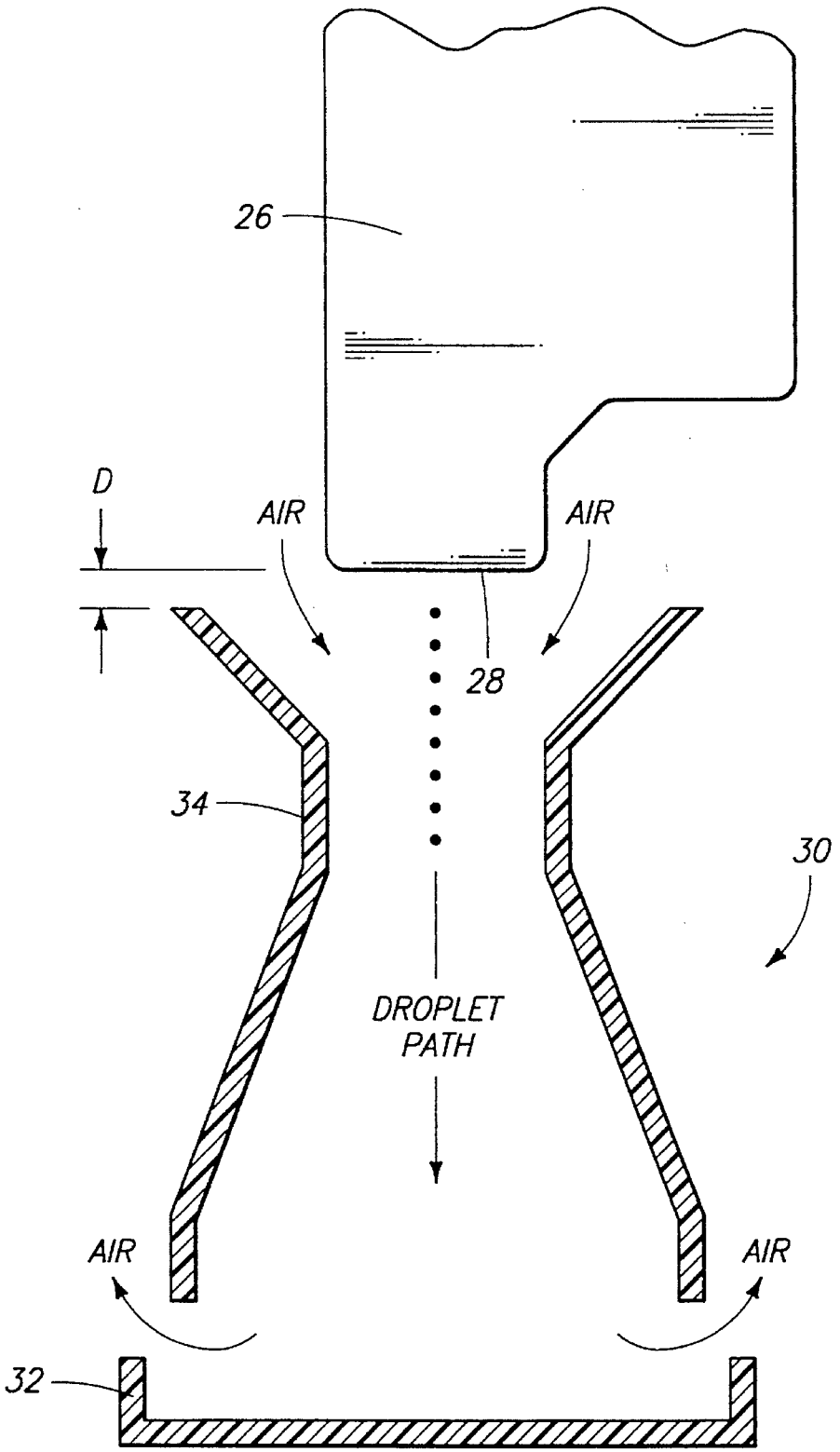
FIG. 2 is an illustrative, partial cross-sectional, side view of the reservoir assembly positioned beneath the printhead.

FIG. 2 shows printhead 26 at service station 16 and overlying reservoir assembly 30. Nozzle plate 28 of printhead 26 is adjacent to, but slightly spaced from, venturi passage 34 when the printhead is positioned above the reservoir assembly. Preferably, the printhead nozzle plate 28 is spaced by a distance D of approximately 0.5 to 10 mm, with a more preferred spacing distance D being about 2 to 10 mm.

Once the printhead is positioned over reservoir assembly 30, it is fired many times (perhaps hundreds or thousands of times) to clear the nozzles and orifices of any ink build-up or debris. The ink droplets exit the printhead at a comparatively high velocity into venturi passageway 34. The ink droplets entrain the surrounding air to create an air flow into the reservoir. Venturi passageway 34 increases the velocity of the ink-containing air stream and lowers static pressure according to Bernoulli's principle as the stream flows toward reservoir 32. This creates a pressure gradient within the passageway that causes the air surrounding the droplet stream to flow in towards the stream and reservoir. This inward flow entrains any misdirected droplets that otherwise would be free to deposit elsewhere in the printing mechanism and forces the droplets into reservoir 32.

The venturi effect increases the distance the drops travel before they slow down to equilibrium velocity. The venturi effect also reduces backflow of aerosol towards the printhead. As a result, the tendency of the droplets to migrate out of reservoir 32 before they deposit on the reservoir walls is reduced.

Figure 3:
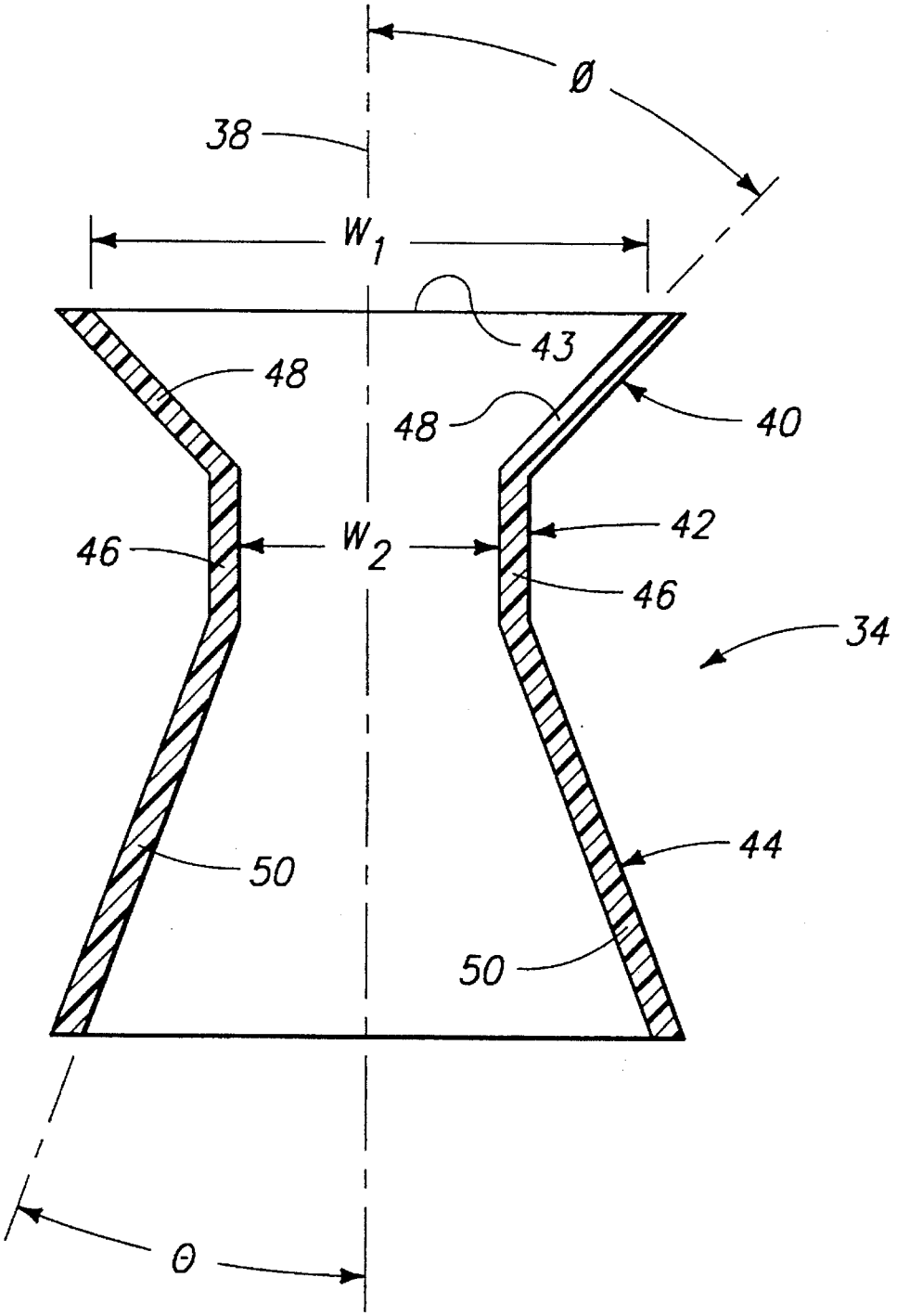
FIG. 3 is a diagrammatical cross-sectional view of a venturi passageway used in the reservoir assembly of FIGS. 1 and 2 according to one embodiment of this invention.

FIG. 3 shows the construction of venturi passageway 34 in more detail. The illustrated venturi passageway 34 is tubular shaped and may be oriented along a first axis, here, illustrated as a central axis 38. The passageway has a converging section 40 leading into a narrow throat or constricted section 42 and a diverging section 44 leading away from the constricted section 42. The venturi passageway is oriented within the service station such that converging section 40 is adjacent to the nozzle section 28 of the printhead, as shown in FIGS. 1 and 2. The uppermost part of converging section 42 defines an entry opening 43 that has a width $W_1$.

Constricted section 42 has walls 46 that are substantially parallel to central axis 38. The constricted section has a width $W_2$ between walls 46 which is approximately 30%–50% of the width $W_1$ of entry opening 43. The converging section 40 has walls 48 which form an angle f of approximately 40° to 50° relative to central axis 38. The diverging section 44 has walls 50 which form an angle q of approximately 15° to 25° relative to central axis 38.

Figure 4:
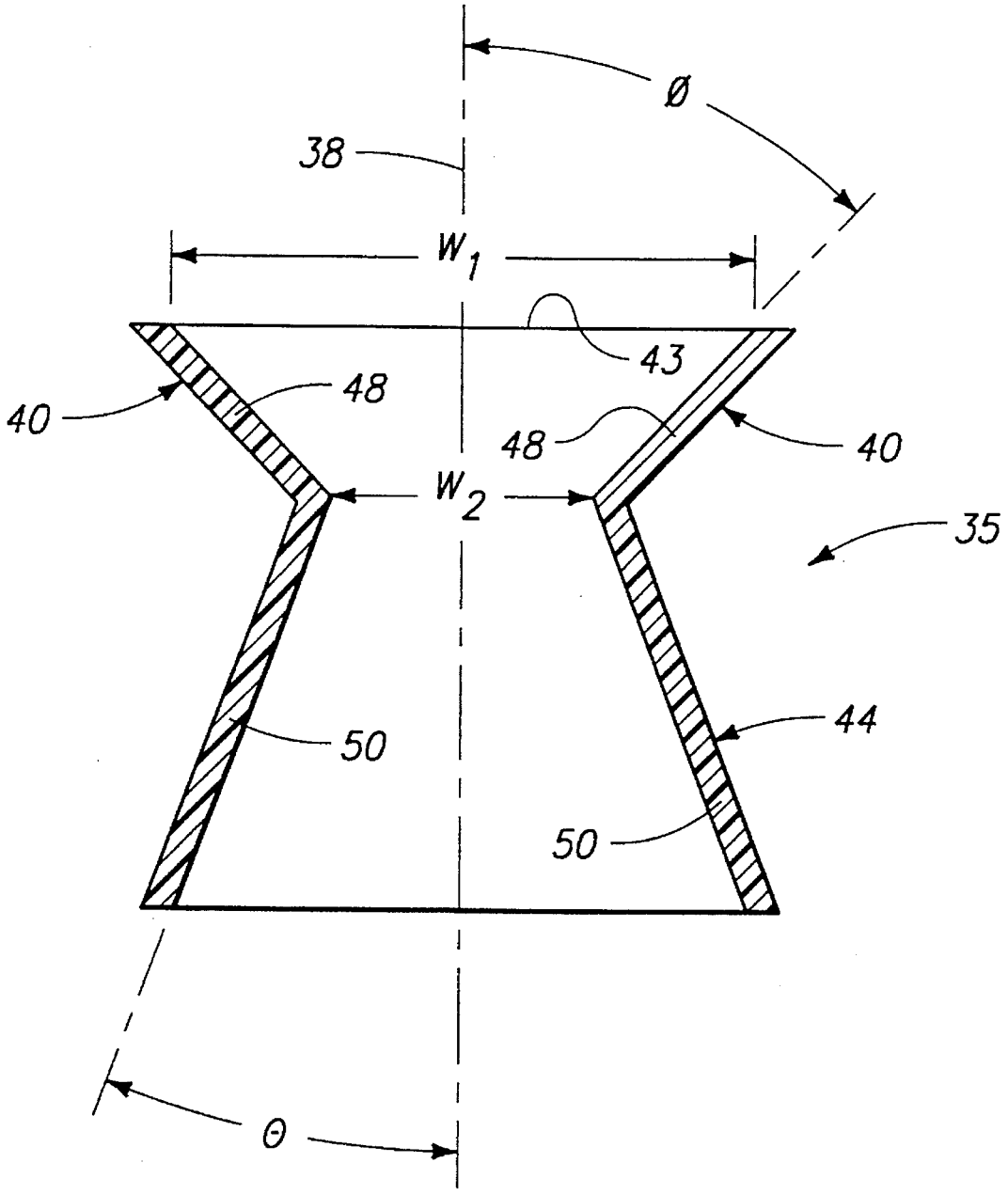
FIG. 4 is a diagrammatical cross-sectional view of a venturi tube according to another embodiment of this invention.

FIG. 4 shows a modified venturi passageway 35 according to another aspect of this invention. Venturi passageway 35 is similar to venturi passageway 34 of FIG. 3, but is constructed without a parallel-walled constricted section. Instead, the converging section 40 leads directly into the diverging section 44. The relative widths $W_1$ (at the entry opening) and $W_2$ (at the narrowmost intersection between the converging and diverging sections), and the angles f and q of the venturi walls are essentially the same as described above in FIG. 3.

Figure 5:
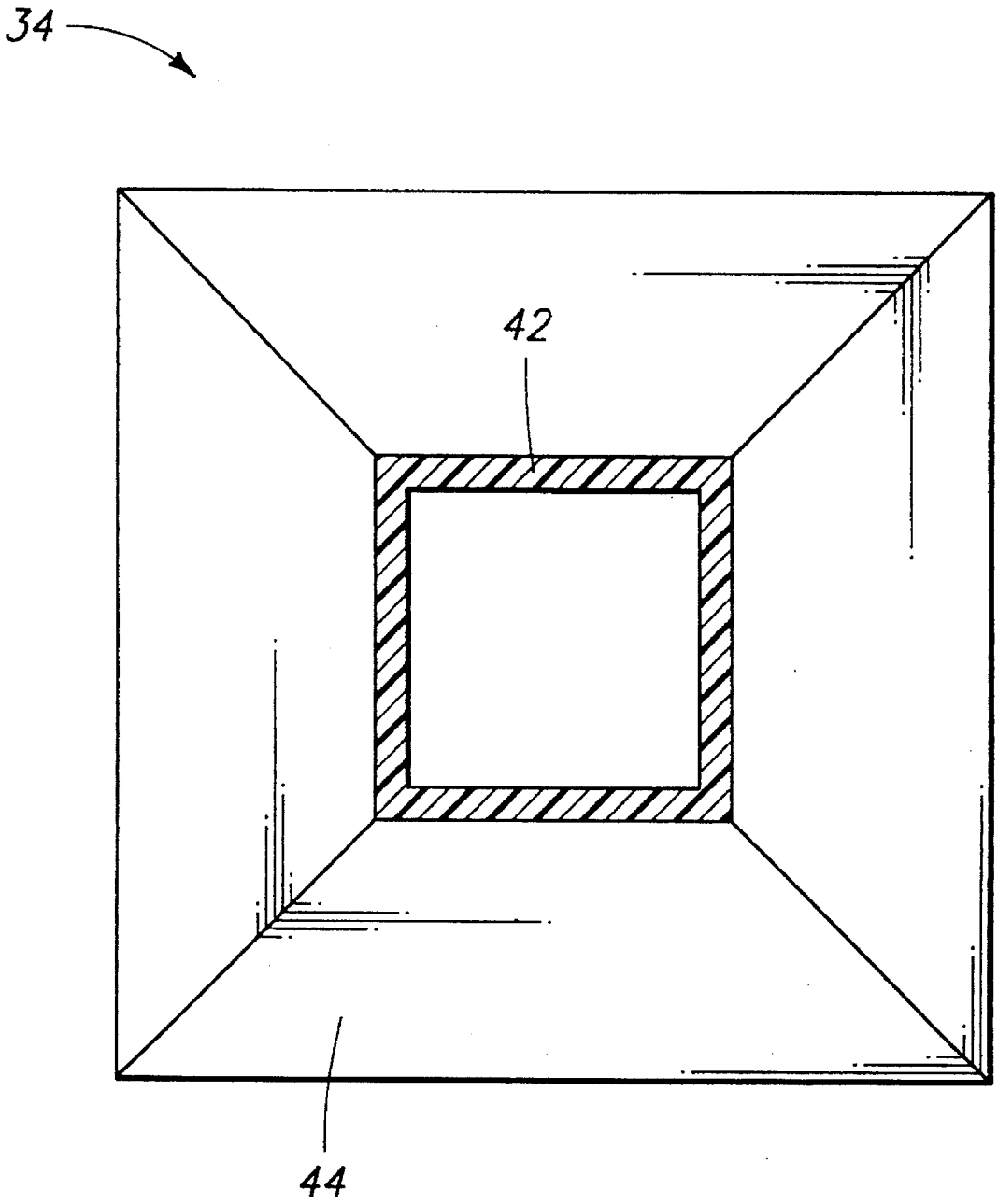
FIG. 5 is a cross-sectional view take through line 5—5 in FIG. 1.

FIG. 5 shows a cross-section of the venturi passageway taken through constricted section 42, as indicated by line 5—5 in FIG. 1. The illustrated venturi passageway is rectangular in cross-section. However, many other shapes and configurations are possible, such as passageways with annular cross-sections in which the constricted section is cylindrical and the converging and diverging sections are conical. As another example embodiment, two opposing walls may form the converging and diverging surfaces, with the remaining two opposing walls being straight and parallel.

Figure 6:
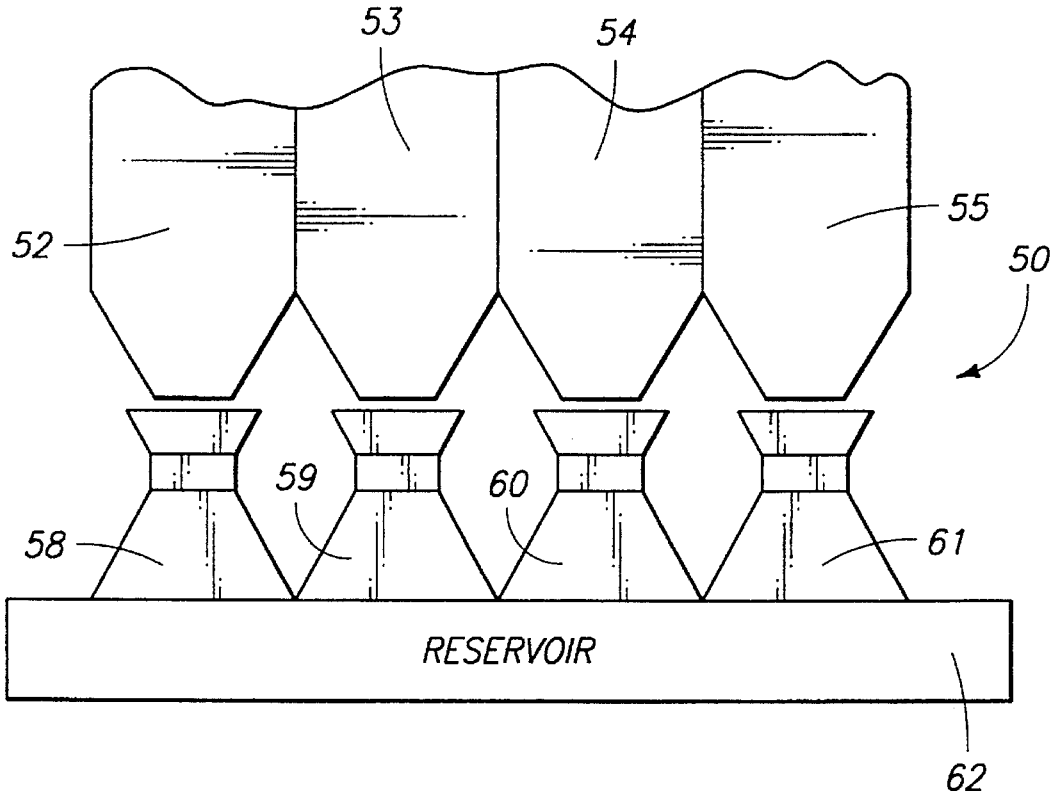
FIG. 6 is a diagrammatical side view of multiple printheads positioned above multiple venturi tubes according to another aspect of this invention.

FIG. 6 shows a modified reservoir assembly 50 according to another aspect of this invention. This reservoir assembly 50 is suitable for use in inkjet printing mechanisms having multiple printheads. Here, printheads 52–55 are mounted to the carriage (not shown). To accommodate the multiple printheads, multiple venturi passageways 58–61 are provided at reservoir assembly 50 for corresponding printheads. Each venturi passageway directs the ink droplets ejected by each associated printhead into common reservoir 62.

The reservoir assembly of this invention is advantageous because it provides an efficient and effective technique for controlling inkjet aerosol. The venturi-based reservoir assembly is small and low cost. Additionally, absorbent surfaces which tend to clog and shorten the life of reservoirs can be eliminated.

We claim:

1. An inkjet printing mechanism, comprising:

an inkjet printhead which controllably ejects multiple ink droplets;

a carriage that carries the printhead through a print zone to a service station where the printhead ejects ink droplets during a servicing mode;

a reservoir located at the service station to collect the ejected ink droplets; and a venturi passageway positioned adjacent to the reservoir to receive and guide ejected ink droplets into the reservoir.

2. An inkjet printing mechanism according to claim 1 wherein the venturi passageway is rectangular in cross-section.

3. An inkjet printing mechanism according to claim 1 wherein the venturi passageway has a converging section leading into a constricted section and a diverging section leading away from the constricted section, the converging section having an entry opening with a width $W_1$ and the constricted section having a width $W_2$ that is approximately 30%–50% of the entry opening width $W_1$.

4. An inkjet printing mechanism according to claim 1 wherein the venturi passageway has a converging section leading into a diverging section at a narrowmost intersection, the converging section having an entry opening with a width $W_1$ and the narrowmost intersection having a width $W_2$ that is approximately 30%–50% of the entry opening width $W_1$.

5. An inkjet printing mechanism according to claim 1 wherein:

the venturi passageway is aligned along a first axis and has a converging section leading into a constricted section and a diverging section leading away from the constricted section;

the constricted section has walls that are substantially parallel to the first axis;

the converging section has walls which form an angle of approximately 40° to 50° relative to the first axis; and the diverging section has walls which form an angle of approximately 15° to 25° relative to the first axis.

6. An inkjet printing mechanism according to claim 1 wherein:

the venturi passageway is aligned along a first axis and has a converging section and a diverging section;

the converging section has walls which form an angle of approximately 40° to 50° relative to the first axis; and the diverging section has walls which form an angle of approximately 15° to 25° relative to the first axis.

7. An inkjet printing mechanism according to claim 1 wherein the venturi passageway has a converging section leading into a constricted section and a diverging section leading away from the constricted section, the venturi passageway being oriented at the service station such that the converging section is adjacent to, but spaced from, the printhead when the printhead is positioned at the service station.

8. An inkjet printing mechanism according to claim 1 further comprising: multiple printheads mounted on the carriage; and multiple venturi passageways for associated printheads, the venturi passageways directing ink droplets from the associated printheads into the reservoir.

9. An inkjet printing mechanism, comprising:

an inkjet printhead which controllably ejects multiple ink droplets;

a carriage that carries the printhead through a print zone to a service station where the printhead ejects ink droplets during a servicing mode;

a reservoir assembly located at the service station to receive the ejected ink droplets, the reservoir assembly having a reservoir to collect the ink droplets and a venturi passageway positioned intermediate of the printhead and reservoir to receive and guide the ink droplets ejected from the printhead into the reservoir, the venturi passageway being aligned along a first axis;

the venturi passageway having a converging section leading into a constricted section and a diverging section leading away from the constricted section, the venturi passageway being oriented in the reservoir assembly so that the printhead is adjacent to, but spaced from, the converging section when the printhead is positioned at the service station; and the constricted section having walls that are substantially parallel to the first axis, the converging section having walls which form an angle of approximately 40° to 50° relative to the first axis, and the diverging section having walls which form an angle of approximately 15° to 25° relative to the first axis.

10. An inkjet printing mechanism according to claim 9 wherein the venturi passageway is rectangular in cross-section.

11. An inkjet printing mechanism according to claim 9 wherein the converging section has an entry opening with a width $W_1$ and the constricted section has a width $W_2$ that is approximately 30%–50% of the entry opening width $W_1$.

12. An inkjet printing mechanism according to claim 9 wherein the printhead is spaced from the converging section by a distance of approximately 0.5 to 10 mm when the printhead is positioned adjacent to the reservoir assembly.

13. An inkjet printing mechanism according to claim 9 further comprising:

multiple printheads mounted on the carriage; and the reservoir assembly having multiple venturi passageways for associated printheads.

14. A reservoir assembly for use in an inkjet printing mechanism, the inkjet printing mechanism having an inkjet printhead which controllably ejects multiple ink droplets, the reservoir assembly comprising:

a reservoir for collecting ink droplets ejected by an inkjet printhead during a servicing mode;

a venturi passageway positioned adjacent to the reservoir to direct the ink droplets ejected by the inkjet printhead into the reservoir; and the venturi passageway having an entry opening with a width $W_1$ and a narrowmost portion with a width $W_2$ that is approximately 30%–50% of the entry opening width $W_1$.

15. A reservoir assembly for use in an inkjet printing mechanism, the inkjet printing mechanism having an inkjet printhead which controllably ejects multiple ink droplets, the reservoir assembly comprising:

a reservoir for collecting ink droplets ejected by an inkjet printhead during a servicing mode;

a venturi passageway positioned adjacent to the reservoir to direct the ink droplets ejected by the inkjet printhead into the reservoir;

the venturi passageway being aligned along a central axis and having a converging section leading into a constricted section and a diverging section leading away from the constricted section;

the constricted section having walls that are substantially parallel to the central axis;

the converging section having walls which form an angle of approximately 40° to 50° relative to the central axis; and the diverging section having walls which form an angle of approximately 15° to 25° relative to the central axis.

16. A reservoir assembly for use in an inkjet printing mechanism, the inkjet printing mechanism having an inkjet printhead which controllably ejects multiple ink droplets, the reservoir assembly comprising:

a reservoir for collecting ink droplets ejected by an inkjet printhead during a servicing mode;

a venturi passageway positioned adjacent to the reservoir to direct the ink droplets ejected by the inkjet printhead into the reservoir;

the venturi passageway being aligned along a central axis and having a converging section and a diverging section;

the converging section having walls which form an angle of approximately 40° to 50° relative to the central axis; and the diverging section having walls which form an angle of approximately 15° to 25° relative to the central axis.

17. A reservoir assembly according to claim 16 wherein the venturi passageway is rectangular in cross-section.

18. A method for controlling inkjet aerosol, comprising the following steps:

ejecting ink droplets at a velocity at a service station;

accelerating the velocity of the ejected ink droplets;

directing the accelerated ink droplets toward a reservoir located at the service station; and collecting the directed ink droplets in the reservoir.

19. A method for controlling inkjet aerosol according to claim 18 wherein the steps of accelerating and directing comprise passing the ejected ink droplets through a venturi passageway.

* * * * *